US012583660B2

(12) United States Patent
Suehiro et al.

(10) Patent No.: US 12,583,660 B2
(45) Date of Patent: Mar. 24, 2026

(54) SHOCK ABSORBER AND PACKAGING SYSTEM

(71) Applicants: Shinya Suehiro, Kanagawa (JP); Yuta Kobayashi, Kanagawa (JP); Tadakatsu Ikeda, Kanagawa (JP)

(72) Inventors: Shinya Suehiro, Kanagawa (JP); Yuta Kobayashi, Kanagawa (JP); Tadakatsu Ikeda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 5 days.

(21) Appl. No.: 18/225,159

(22) Filed: Jul. 24, 2023

(65) Prior Publication Data

US 2024/0034537 A1 Feb. 1, 2024

(30) Foreign Application Priority Data

Jul. 29, 2022 (JP) ..... 2022-121647
Jan. 27, 2023 (JP) ..... 2023-010856

(51) Int. Cl.
*B65D 81/02* (2006.01)

(52) U.S. Cl.
CPC ..... *B65D 81/022* (2013.01)

(58) Field of Classification Search
CPC ..... B65D 81/022; B65D 81/058
USPC ..... 206/521, 523
See application file for complete search history.

(56) References Cited

U.S. PATENT DOCUMENTS 2,941,708 A * 6/1960 Crane ..... B65D 1/225 206/521
3,251,460 A * 5/1966 Edmonds ..... B65D 81/022 220/675
3,327,882 A * 6/1967 Andrews ..... B65D 90/06 220/592.25

(Continued)

FOREIGN PATENT DOCUMENTS

CN 2763208 Y 3/2006
CN 203793928 U 8/2014

(Continued)

OTHER PUBLICATIONS

Office Action issued Aug. 5, 2025 in corresponding Chinese Patent Application No. 202310893768.5 (7 pages).

*Primary Examiner* — Orlando E Aviles
*Assistant Examiner* — Jenine Spicer
(74) *Attorney, Agent, or Firm* — XSENSUS LLP

(57) ABSTRACT

A shock absorber and two packaging systems. The shock absorber is to be attached to an object to be packaged, and the shock absorber includes a first shock absorber including a first base structure having a frame shape and at least one first shock-absorbing rib disposed inside the first base structure, and a second shock absorber having a second base structure in a shape of a plate and at least one second shock-absorbing rib disposed on a plane of the second base structure. In the shock absorber, the first shock absorber and the second shock absorber are coupled to each other. One of the two packaging systems includes shock absorbers including the shock absorber, and two of the shock absorbers are used for each object to be packaged. In the other one of the two packaging systems, four of the shock absorbers are used for each object to be packaged.

18 Claims, 10 Drawing Sheets

(56) References Cited

U.S. PATENT DOCUMENTS 4,082,187 A * 4/1978 Carlson ..... B65D 25/107 220/23.6
4,145,895 A * 3/1979 Hjertstrand ..... F25D 3/00 165/47
6,003,706 A * 12/1999 Rosen ..... B65D 21/083 220/4.26
6,230,895 B1 * 5/2001 Laube ..... H01L 21/67386 206/454
6,742,655 B2 * 6/2004 Kasakura ..... B65D 81/133 206/592
6,827,231 B2 * 12/2004 Budowski ..... B60R 11/06 220/4.28
7,681,405 B2 * 3/2010 Williams ..... F25D 3/08 220/592.2
8,025,150 B2 * 9/2011 Okuma ..... B65D 81/113 206/320
8,657,109 B2 * 2/2014 Ouzts ..... B65D 11/188 206/217
10,618,690 B2 * 4/2020 Jobe ..... B65D 81/3816
2007/0095703 A1 * 5/2007 Kao ..... B65D 85/48 206/454
2013/0220866 A1 * 8/2013 Nakamura ..... B65D 81/113 206/523
2014/0061088 A1 * 3/2014 Nakamura ..... B65D 5/5069 206/521
2014/0102938 A1 * 4/2014 Chien ..... B65D 81/022 206/592
2016/0159549 A1 * 6/2016 Yeh ..... B65D 81/022 206/523
2018/0237206 A1 * 8/2018 Jobe ..... B65B 55/20
2021/0387765 A1 12/2021 Suehiro
2021/0394950 A1 12/2021 Suehiro
2022/0267046 A1 8/2022 Suehiro
2023/0020334 A1 1/2023 Suehiro
2023/0040304 A1 2/2023 Sushiro

FOREIGN PATENT DOCUMENTS

CN 214190512 U 9/2021
JP 11-124181 5/1999
JP 2008-184181 8/2008
JP 2017-202874 11/2017
JP 2021-195156 12/2021
TW 428592 U 4/2001
TW 544748 B 8/2003

* cited by examiner

SHOCK ABSORBER AND PACKAGING SYSTEM

CROSS-REFERENCE, TO RELATED APPLICATIONS

This patent application is based on and claims priority pursuant to 35 U.S.C. § 119(a) to Japanese Patent Application Nos. 2022-121647 and 2023-010856, filed on Jul. 29, 2022, and Jan. 27, 2023, respectively, in the Japan Patent Office, the entire disclosures of which are hereby incorporated by reference herein.

BACKGROUND

Technical Field

Embodiments of the present disclosure relate to a shock absorber and a packaging system.

Background Art

The structure or shape of shock absorbers that are used as a packaging material is determined based on the shape or strength of the object to be packaged, and the object to be packaged wears such shock absorbers. Moreover, such shock absorbers are packed in an outer packaging box, and serve as part of packaged baggage. As known in the art, a desired function of shock absorbers is to lessen the impact of the shock on the object to be packaged when the packaged baggage drops or falls off during cargo handling.

As illustrated in FIG. 1, the shock absorber is composed of a base structure 10 and a shock-absorbing rib 12 mounted on the base structure 10 to lessen the impact of shock, and such a rib will be referred to as a shock-absorbing rib in the following description. The height h of the shock-absorbing rib 12 and the shaded area S in which the object to be packaged contacts the shock-absorbing rib 12 can be adjusted to lighten the acceleration of the impact that is applied to the object to be packaged at the time of falling or drop.

The shock absorber according to the related art is classified into three types including an inner rib (see, for example, FIG. 2) in which the shock-absorbing rib 12 is arranged on the inner side of the base structure 10 to face the object to be packaged, an outer rib (see, for example, FIG. 3) in which the shock-absorbing rib 12 is arranged on the other side of the object to be packaged, and a coexisting rib where the inner rib coexists with the outer rib.

The inner rib has a configuration in which the object to be packaged contacts the shock-absorbing rib 12, and implements a shock-absorbing design or technique to adjust the acceleration of impact. Due to such a configuration, the acceleration of the impact that is applied to the object to be packaged can easily be adjusted.

SUMMARY

Embodiments of the present disclosure described herein provide a shock absorber and two kinds of packaging system. The shock absorber is to be attached to an object to be packaged, and the shock absorber includes a first shock absorber including a first base structure having a frame shape and at least one first shock-absorbing rib disposed inside the first base structure, and a second shock absorber having a second base structure in a shape of a plate and at least one second shock-absorbing rib disposed on a plane of the second base structure. In the shock absorber, the first shock absorber and the second shock absorber are coupled to each other. One of the two packaging systems includes a plurality of shock absorbers including the shock absorber, and two of the shock absorbers are used for each object to be packaged. The other one of the two packaging systems includes a plurality of shock absorbers including the shock absorber, and four of the shock absorbers are used for each object to be packaged.

BRIEF DESCRIPTION OF DRAWINGS

A more complete appreciation of embodiments and the many attendant advantages thereof will be readily obtained as the same becomes better understood by reference to the following detailed description when considered in connection with the accompanying drawings.

FIG. 11A, FIG. 11B, and FIG. 11C are a top view of the shock absorber frame, a front view of the shock absorber frame, and a perspective view of the shock absorber frame, respectively.

FIG. 12A, FIG. 12B, and FIG. 12C are a front view of the shock absorber plate, a side view of the shock absorber plate, and a perspective view of the shock absorber plate, respectively.

FIG. 13A, FIG. 13B, and FIG. 13C are a front view of the shock absorber frame and the shock absorber plate, a side view of the shock absorber frame and the shock absorber plate, and a perspective view of the shock absorber frame and the shock absorber plate, respectively.

FIG. 14A, FIG. 14B, and FIG. 14C are a front view of the shock absorber frame, a side view of the shock absorber frame, and a perspective view of the shock absorber frame, respectively.

FIG. 15A, FIG. 15B, and FIG. 15C are a front view of the shock absorber plate, a side view of the shock absorber plate, and a perspective view of the shock absorber plate, respectively.

FIG. 16A, FIG. 16B, and FIG. 16C are a top view of the shock absorber frame, a front view of the shock absorber frame, and a perspective view of the shock absorber frame, respectively.

FIG. 17A, FIG. 17B, and FIG. 17C are a front view of the shock absorber frame, a side view of the shock absorber frame, and a perspective view of the shock absorber frame, respectively.

FIG. 18A, FIG. 18B, and FIG. 18C are a front view of the shock absorber plate, a side view of the shock absorber plate, and a perspective view of the shock absorber plate, respectively.

FIG. 19A, FIG. 19B, and FIG. 19C are a front view of the shock absorber frame and the shock absorber plate, a side view of the shock absorber frame and the shock absorber plate, and a perspective view of the shock absorber frame and the shock absorber plate, respectively.

Figure 1:
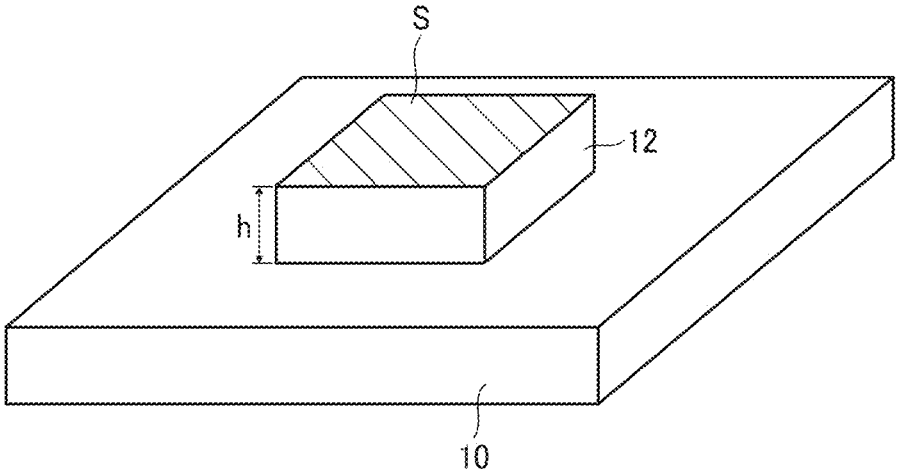
FIG. 1 Prior Art
FIG. 1 is a perspective view of a shock absorber and illustrates a basic configuration of the shock absorber, according to the related art.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the present disclosure is not intended to be limited to the specific terminology so selected and it is to be understood that each specific element includes all technical equivalents that have the same structure, operate in a similar manner, and achieve a similar result.

Figure 4:
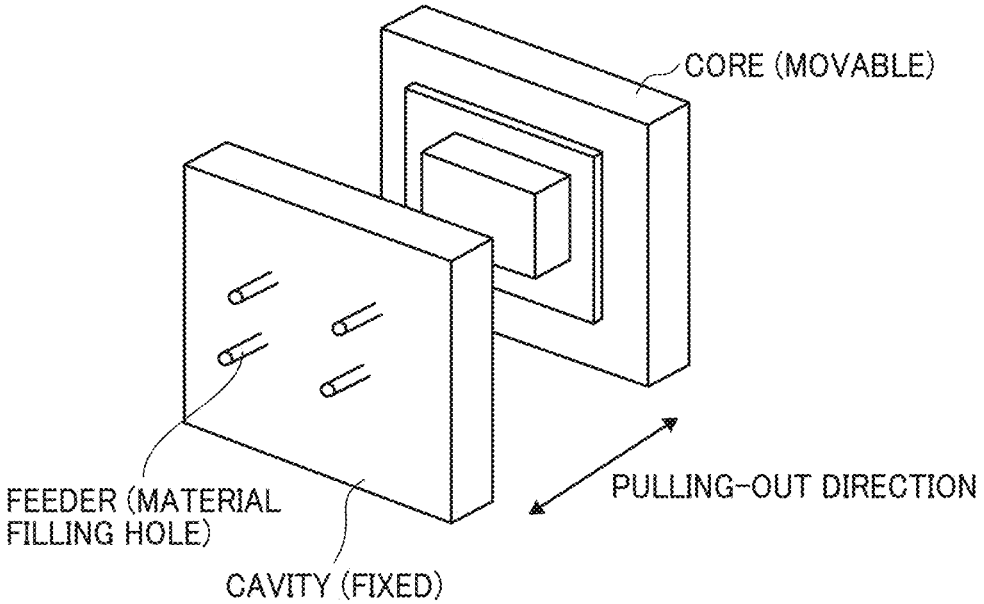
FIG. 4 Prior Art
FIG. 4 is a perspective view of a mold used to manufacture a shock absorber, according to the related art.

As known in the art, shock absorbers are manufactured using a die or mold for mass production such as an injection molding machine and a vacuum molding machine. As illustrated in FIG. 4, such shock absorbers are subject to constraints such as the direction in which a pair of metal molds consisting of a core and a cavity are pulled out and removed. In particular, in a shock absorber with an inner rib, the shock-absorbing ribs 12 are integrally molded with the base structure 10 (see, for example, FIG. 2).

Figure 2:
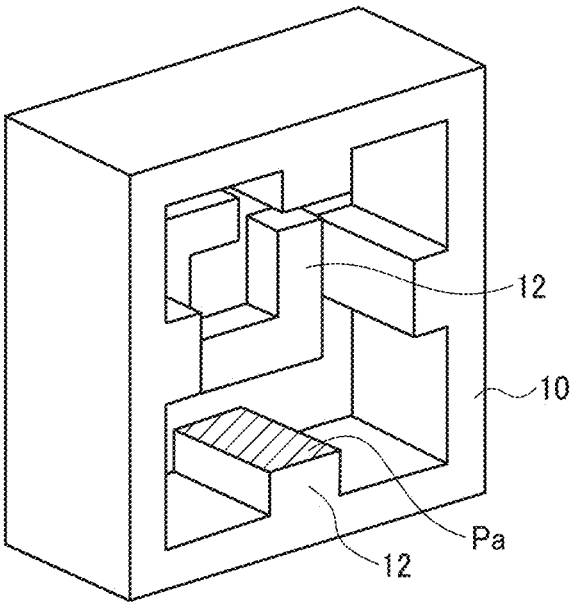
FIG. 2 Prior Art
FIG. 2 is a perspective view of a shock absorber with an inner rib, according to the related art.
Figure 3:
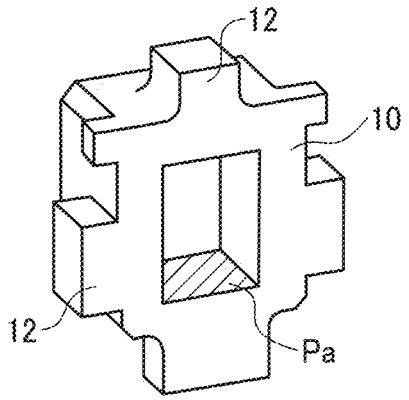
FIG. 3 Prior Art
FIG. 3 is a perspective view of a shock absorber with an outer rib, according to the related art.
Figure 5A:
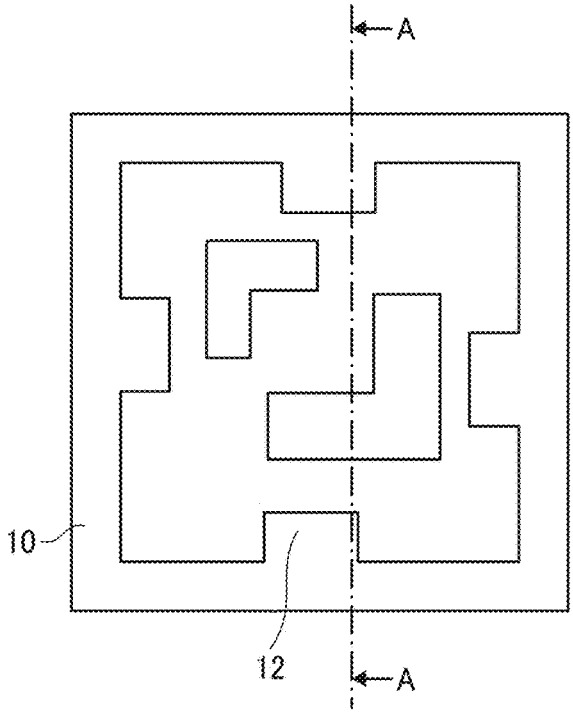
FIG. 5A Prior Art
FIG. 5A is a front view of the shock absorber of FIG. 2 into which a to-be-packaged object is inserted from above, according to the related art.

FIG. 5A is a front view of the shock absorber of FIG. 2 into which a to-be-packaged object 14 is inserted from above, according to the related art.

Figure 5B:
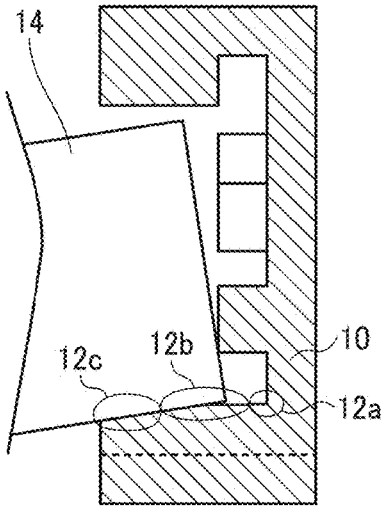
FIG. 5B Prior Art
FIG. 5B is an A-A sectional view of a shock-absorbing rib and illustrates the deformation on the shock-absorbing rib, according to the related art.

FIG. 5B is an A-A sectional view of the shock absorber and illustrates the deformation on the shock absorber, according to the related art.

When the shock-absorbing rib 12 is deformed to lessen the acceleration of the impact that is applied to the to-be-packaged object 14 at the time of falling or drop, the shock-absorbing rib 12 is connected to or integrated with a frame portion of the base structure 10 or a plate-like bottom side of the base structure 10. In view of the above circumstances, even if the shock-absorbing rib 12 is deformed at the time of falling or dropped, a portion 12*b* close to a bottom side of the base structure 10 and a boundary portion 12*a* of the base structure 10 are pulled toward the base structure 10. Accordingly, the shock-absorbing rib 12 may not deform evenly with respect to the tangent plane that the to-be-packaged object 14 contacts in a vertical direction. In other words, a portion 12*b* with a relatively small deformation and a portion 12*c* with a relatively great deformation are mixed.

As the height h of the shock-absorbing rib 12 and the shaded area S in which the to-be-packaged object 14 contacts the shock-absorbing rib 12 is adjusted or adjustment with other shock-absorbing ribs is performed, the acceleration of the impact that is applied to the to-be-packaged object 14 at the time of falling or drop may not be lessened to a target level. Due to such a configuration, there is some concern that the to-be-packaged object 14 may be damaged.

In the embodiments of the present disclosure described below, a shock absorber with an inner rib is described in which unwanted integration of the shock-absorbing rib 12 with the base structure 10 can be partially resolved to increase the level of shock-absorbing effects.

EMBODIMENTS

Figure 6:
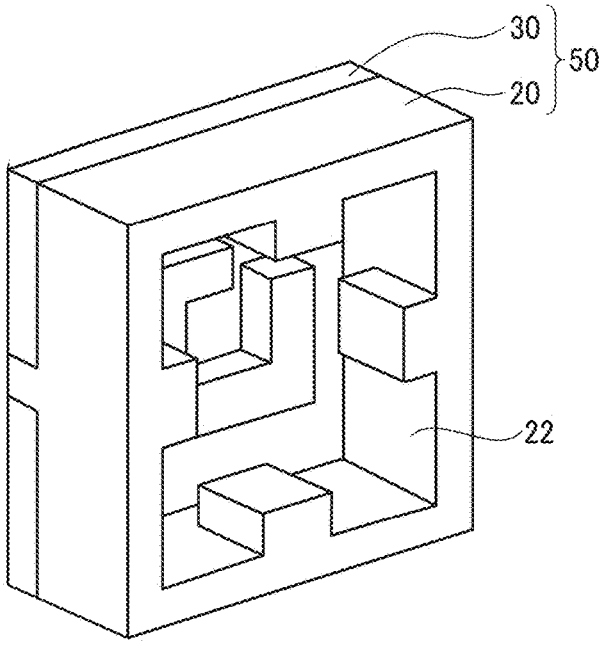
FIG. 6 is a perspective view of a shock absorber according to an embodiment of the present disclosure.

FIG. 6 is a perspective view of the shock absorber 50 according to the present embodiment.

Figure 7A:
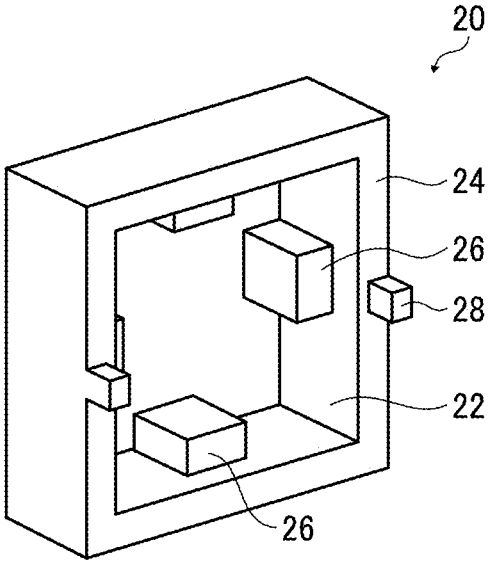
FIG. 7A is a perspective view of a shock absorber frame that makes up the shock absorber of FIG. 6, according to an embodiment of the present disclosure.
Figure 7B:
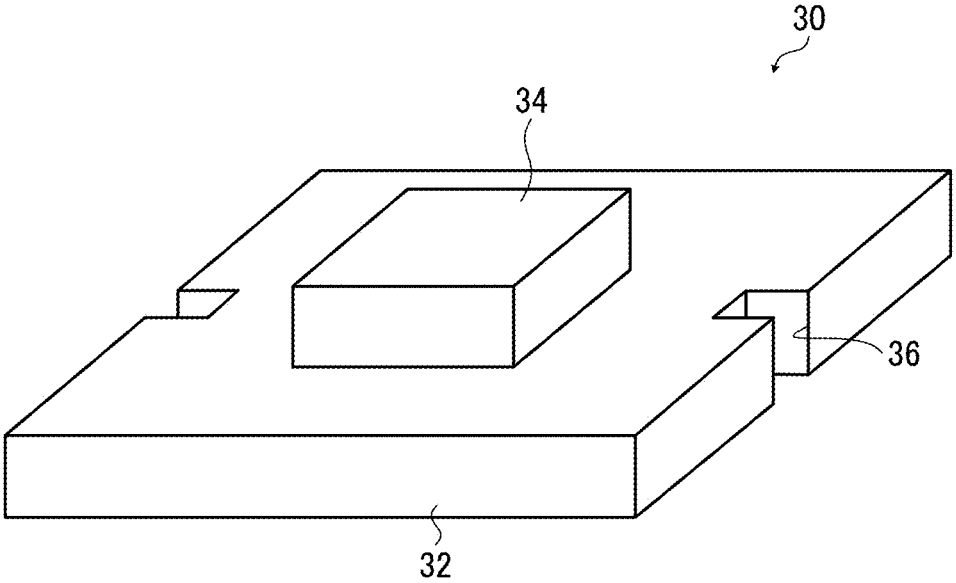
FIG. 7B is a perspective view of a shock absorber plate that makes up the shock absorber of FIG. 6, according to an embodiment of the present disclosure.

FIG. 7A and FIG. 7B are perspective view of the elements that make up the shock absorber 50 of FIG. 6, according to the present embodiment.

FIG. 7A is a perspective view of the shock absorber frame 20 that makes up the shock absorber 50 of FIG. 6, according to the present embodiment. FIG. 7B is a perspective view of the shock absorber plate 30 that makes up the shock absorber 50 of FIG. 6, according to the present embodiment.

The shock absorber 50 according to the present embodiment includes a shock absorber frame 20 that serves as the first shock absorber and a shock absorber plate 30 that is coupled to the shock absorber frame 20 and serves as the second shock absorber, and has holding space 22 that accommodates at least some of the to-be-packaged object 14.

As illustrated in FIG. 7A, the shock absorber frame 20 according to the present embodiment includes a first base structure 24 that is shaped like an annular frame to form the holding space 22, and a plurality of first shock-absorbing ribs 26 that extend from the inner wall of the first base structure 24 to the center of the holding space 22. The multiple first shock-absorbing ribs 26 contact the to-be-packaged object 14 such that the to-be-packaged object 14 will not contact the inner wall. As illustrated in FIG. 7B, the shock absorber plate 30 according to the present embodiment includes a plate-like second base structure 32 and a second shock-absorbing rib 34 arranged on the top side of the plate surface of the second base structure 32. The second shock-absorbing rib 34 according to the present embodiment extends from a plate surface of the second base structure 32 to the center of the holding space 22 when the shock absorber plate 30 is combined with the shock absorber frame 20, and contacts the to-be-packaged object 14 such that the to-be-packaged object 14 does not contact the plate surface of the second base structure 32.

In order to combine the shock absorber frame 20 and the shock absorber plate a pair of protrusions 28 that are flush with portions of the outer frame of the first base structure 24 are formed on the first base structure 24 of the shock absorber frame 20. In parallel with that, a pair of notch-like recessed portions 36 are formed on the second base structure 32 of the shock absorber plate 30. The pair of protrusions 28 of the shock absorber frame 20 can be attached to and detached from the pair of recessed portions 36 of the shock absorber plate 30. The pair of protrusions 28 are lightly press-fitted into the pair of recessed portions 36. Due to such a configuration, the shock absorber frame 20 and the shock absorber plate 30 are combined together as desired. When one of the shock absorber frame 20 and the shock absorber plate 30 is held in the air, the other one does not fall off.

As illustrated in FIG. 6, the end faces of the pair of protrusions 28 are flush with the other side of the plate surfaces of the second base structure 32 on which the second shock-absorbing rib 34 is not arranged. In other words, the height of each one of the pair of protrusions 28 can be made equivalent to the depth of each one of the pair of recessed portions 36 in the shock absorber 50 according to the present embodiment. The height of each one of the pair of protrusions 28 may be made slightly shorter than the depth of each one of the pair of recessed portions 36.

The front ends of the pair of protrusions 28 that are flush with a face of the outer frame of the first base structure 24 are flush with the outer circumferential surface of the plate-like second base structure 32 of the shock absorber plate 30. Due to such a configuration as described above, for example, the pair of protrusions 28 of the combined shock absorber can be prevented from being caught when the combined shock absorber is packed in an outer packaging box, and the shock absorber material can be prevented from being separated from each other. When the pair of protrusions 28 are lightly press-fitted into the pair of recessed portions 36 to combine the shock absorber frame 20 and the shock absorber plate 30, the contact surface of one of or both the protrusion 28 and the recessed portion 36 may elastically deform.

In the shock absorber 50 according to the present embodiment, the multiple first shock-absorbing ribs 26 of the shock absorber frame 20 are members separate from the plate-like second base structure 32 of the shock absorber plate 30. Due to such a configuration or structure, when one of the rib and the base structure deforms evenly, the other one does not deform as much as the one of the rib and the base structure that deforms evenly.

Figure 8A:
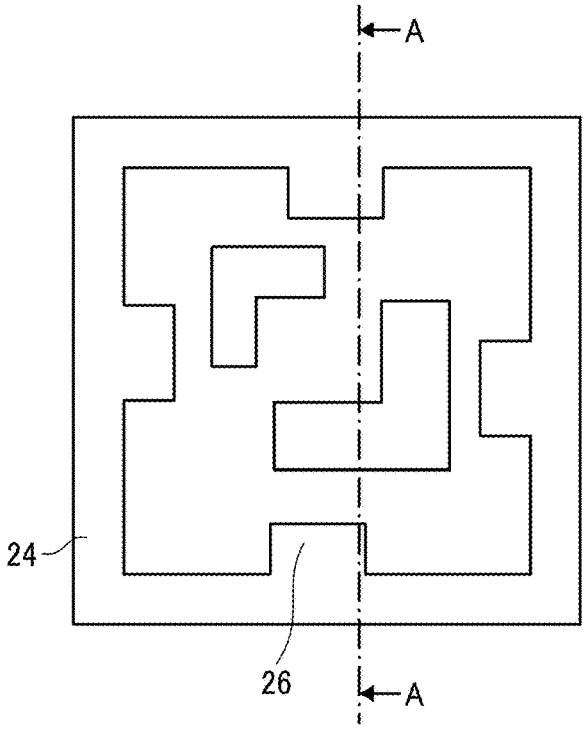
FIG. 8A is a front view of the shock absorber 50 of FIG. 6, according to an embodiment of the present disclosure.

FIG. 8A is a front view of the shock absorber 50 of FIG. 6

Figure 8B:
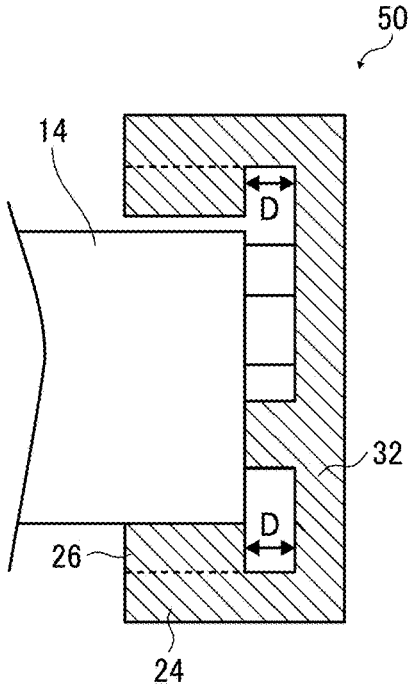
FIG. 8B is an A-A sectional view of the shock absorber of FIG. 6, according to an embodiment of the present disclosure.

FIG. 8B is an A-A sectional view of the shock absorber 50 of FIG. 6, according to the present embodiment.

In the shock absorber 50 according to the present embodiment, the multiple first shock-absorbing ribs 26 of the shock absorber frame 20 are deformed when the shock absorber 50 lessens the impact of shock on the to-be-packaged object 14 in response to the acceleration of the impact that is applied to the to-be-packaged object 14 at the time of falling or drop, but the multiple first shock-absorbing ribs 26 are not affected by the second base structure 32 of the shock absorber plate 30, which is separate from the shock absorber frame 20. For example, the multiple first shock-absorbing ribs 26 are not pulled by the second base structure 32. Due to such a configuration, the multiple first shock-absorbing ribs 26 can deform evenly in the vertical direction that the to-be-packaged object 14 drops, against the abutment plane with the to-be-packaged object 14, and the multiple first shock-absorbing ribs 26 are free from the influence of the plate-like second base structure 32 in the vertical direction. Accordingly, shock-absorbing effects can be achieved.

In the present embodiment, the first base structure 24 of the shock absorber frame 20 contacts the second base structure 32 of the shock absorber plate 30. However, it is desired that the multiple first shock-absorbing ribs 26 of the shock absorber frame 20 be apart from the second base structure 32 of the shock absorber plate 30 as indicated by a reference sign D as illustrated in FIG. 8B. Due to such a configuration, even when the multiple first shock-absorbing ribs 26 are deformed in the horizontal direction, interference from the second base structure 32 such as contact or friction can be prevented, and further shock-absorbing effects can be achieved.

Shock absorbers are known in the art that form a block of shock absorber using a combination of the rectangular-shaped hollow first shock absorber and the U-shaped second shock absorber arranged inside the first shock absorber.

However, the second shock absorber contacts the object to be packaged, and the first shock absorber does not contact the object to be packaged in the block of shock absorber known in the art. Moreover, the outer regions of the first shock absorber contact the outer packaging box in the block of shock absorber known in the art, and the second shock absorber does not evenly deform to lessen the impact in response to the acceleration of the impact that is applied to the to-be-packaged object 14 at the time of falling or drop. Due to such uneven deformation of the second shock absorber, the first shock absorber tends to be deformed unintentionally. For the above reasons, mechanisms to enhance shock-absorbing function as in the embodiments of the present disclosure, which is implemented by separate members with an inner rib, cannot be achieved.

A configuration or structure of a shock absorber according to embodiments of the present disclosure is described below.

Materials of Shock Absorber

It is desired that the shock absorber frame 20 and the shock absorber plate 30 be formed using a packaging material made of form resin. Due to such a configuration, a shock absorber with good shock-absorbing properties and characteristics can be provided at low cost. Alternatively, a shock absorber with good shock-absorbing properties and characteristics may be formed and provided using a packaging material made of pulp molding or a vacuum-formed packaging material made of plastic sheet.

Number of Shock-Absorbing Ribs

In the shock absorber frame 20 according to the present embodiment, two or more first shock-absorbing ribs 26 may be arranged on different inner walls of the first base structure 24 or on the same wall of the first base structure 24. As described above with reference to FIG. 7A and FIG. 7B, a plurality of first shock-absorbing ribs 26 may be arranged on four different inner walls of the frame-like first base structure 24. Such a configuration can lessen the impact of the falling off of a packaged baggage in varying directions, and the degree of shock-absorbing effect can be increased.

Figure 9:
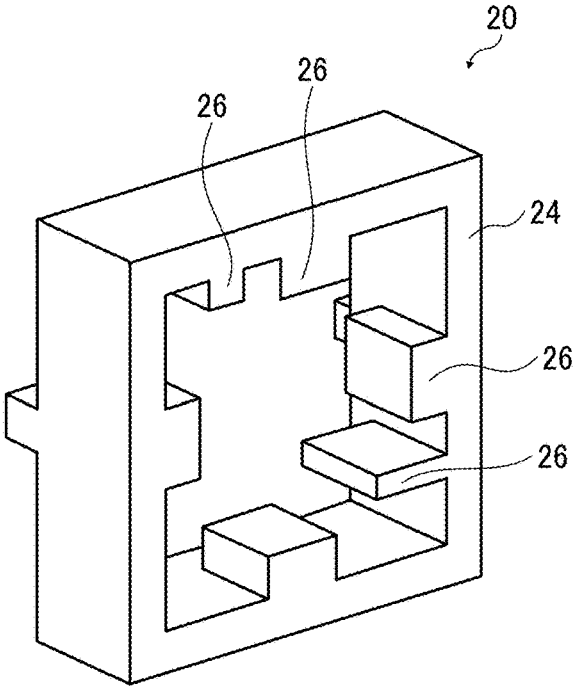
FIG. 9 is a perspective view of a shock absorber frame in which a plurality of first shock-absorbing ribs are arranged on a plurality of walls, according to an embodiment of the present disclosure.

FIG. 9 is a perspective view of the shock absorber frame 20 in which the multiple first shock-absorbing ribs 26 are arranged on a plurality of walls, according to the present embodiment.

As illustrated in FIG. 9, a couple of first shock-absorbing ribs 26 may be arranged on the same wall of the first base structure 24. By arranging a desired number of multiple first shock-absorbing ribs 26 so as to disperse weight percentage and shape of the to-be-packaged object 14, the degree of shock-absorbing effect can further be increased. It is further desirable that such a plurality of first shock-absorbing ribs 26 be arranged other inner walls.

Figure 10:
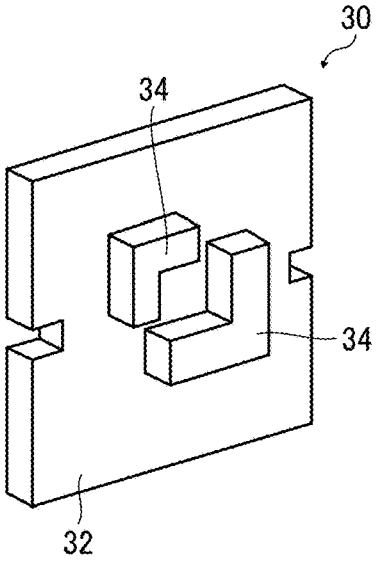
FIG. 10 is a perspective view of a shock absorber plate, where a plurality of second shock-absorbing ribs are arranged on a plane of a second base structure, according to an embodiment of the present disclosure.

FIG. 10 is a perspective view of the shock absorber plate 30, where a plurality of second shock-absorbing ribs 34 are arranged on a plane of the second base structure 32, according to the present embodiment.

Further, two or more second shock-absorbing ribs 34 may be arranged on a plane of the second base structure 32. As illustrated in FIG. 10, a pair of L-shaped second shock-absorbing ribs 34 may be arranged on a plane of the second base structure 32 such that concave or recessed portions of those two second shock-absorbing ribs 34 face each other and those two second shock-absorbing ribs 34 have the same height. Due to such a configuration, the degree of shock-absorbing effect can further be increased.

A method of combining the shock absorber frame and the shock absorber plate according to some modifications of the above embodiments of the present disclosure is described below.

Figure 11A:
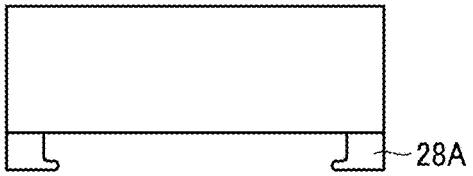
FIG. 11A, FIG. 11B, and FIG. 11C are three-view images of a shock absorber frame and illustrate a pair of claw-shaped protrusions formed on a first base structure, according to the first modification of the above embodiments of the present disclosure, where
Figure 11B:
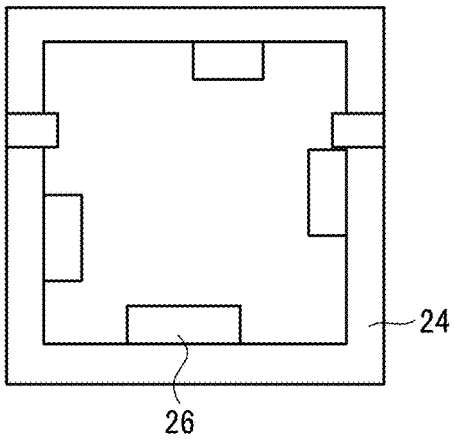
Figure 11C:
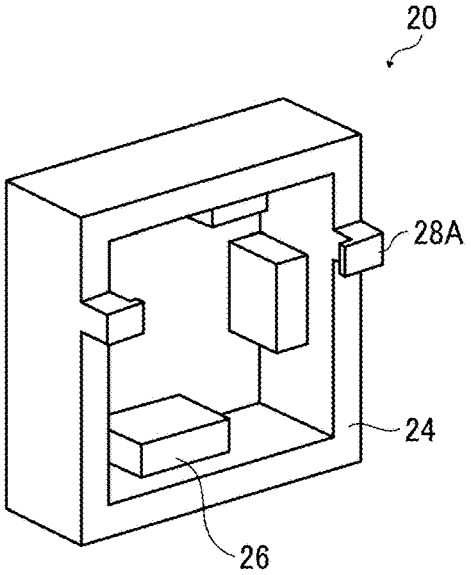

FIG. 11A, FIG. 11B, and FIG. 11C are three-view images of the shock absorber frame 20 and illustrate a pair of claw-shaped protrusions 28*a* formed on the first base structure 24, according to the first modification of the above embodiments of the present disclosure.

Figure 12A:
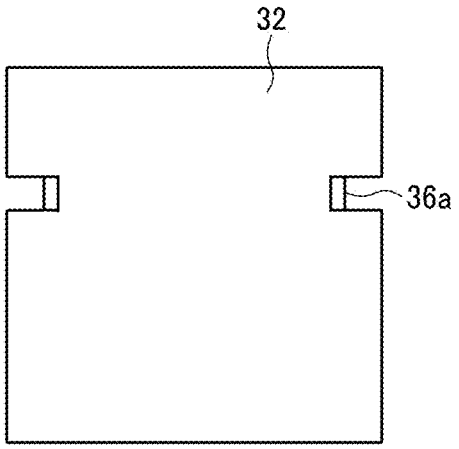
FIG. 12A, FIG. 12B, and FIG. 12C are three-view images of a shock absorber plate and illustrate a pair of concave portions formed on a second base structure, according to the first modification of the above embodiments of the present disclosure, where
Figure 12B:
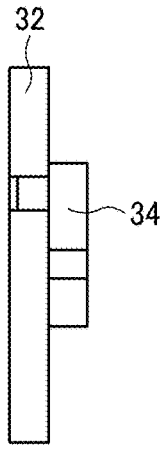
Figure 12C:
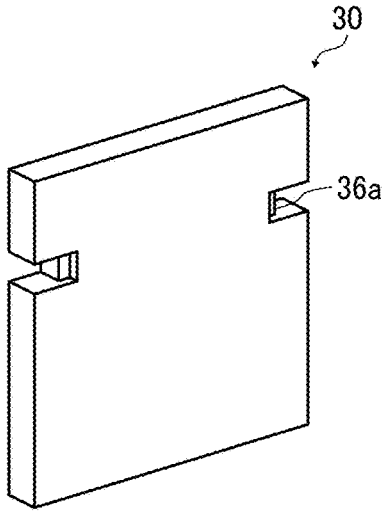

FIG. 12A, FIG. 12B, and FIG. 12C are three-view images of the shock absorber plate 30 and illustrate a pair of concave portions 36*a* formed on the second base structure 32, according to the first modification of the above embodiments of the present disclosure.

Figure 13A:
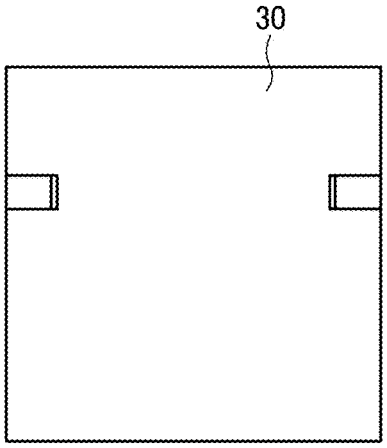
FIG. 13A, FIG. 13B, and FIG. 13C are three-view images of a shock absorber frame and a shock absorber plate and illustrates how the shock absorber frame and the shock absorber plate 30 are combined together, according to the first modification of the above embodiments of the present disclosure, where
Figure 13B:
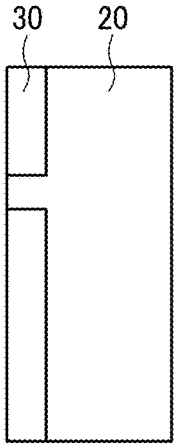
Figure 13C:
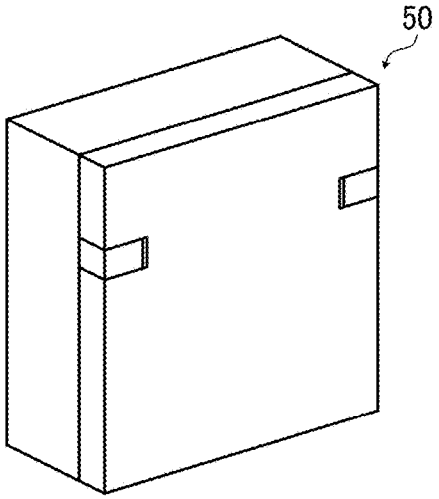

FIG. 13A, FIG. 13B, and FIG. 13C are three-view images of the shock absorber frame 20 and the shock absorber plate 30 and illustrates how the shock absorber frame 20 and the shock absorber plate 30 are combined together, according to the first modification of the above embodiments of the present disclosure.

First Modification

As illustrated in FIG. 11A, FIG. 11B, and FIG. 11C, a pair of claw-shaped protrusions 28*a* are formed on the first base structure 24 of the shock absorber frame 20. As illustrated in FIG. 12A, FIG. 12B, and FIG. 12C, a plurality of concave portions 36*a* are formed on the second base structure 32 of the shock absorber plate 30. The pair of claw-shaped protrusions 28*a* are snap-fitted and engaged with the pair of concave portions 36*a*. Due to such a configuration, as will be described later in detail with reference to FIG. 13A, FIG. 13B, and FIG. 13C, the shock absorber frame 20 and the shock absorber plate 30 can be combined together.

The term "snap fit" indicates an assembling method in which, for example, protrusions arranged on a part such as the pair of claw-shaped protrusions 28*a* are inserted into concave or recessed portions of a receiver such as the pair of concave portions 36*a*, using the elasticity of a material, to achieve mechanical fixation by hooking. Snap fit is an easy and low-cost coupling or bonding method that does not require extra materials, and can combine and bond the shock absorber frame 20 and the shock absorber plate 30 with a sufficient degree of fixing force.

Second Modification

Figure 14A:
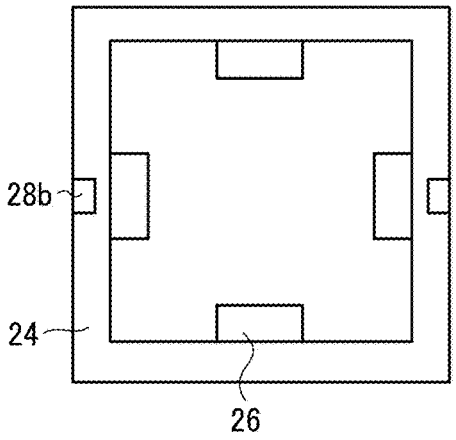
FIG. 14A, FIG. 14B, and FIG. 14C are three-view images of a shock absorber frame and illustrate a pair of rectangular protrusions formed on a first base structure, according to the second modification of the above embodiments of the present disclosure, where
Figure 14B:
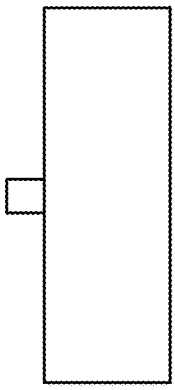
Figure 14C:
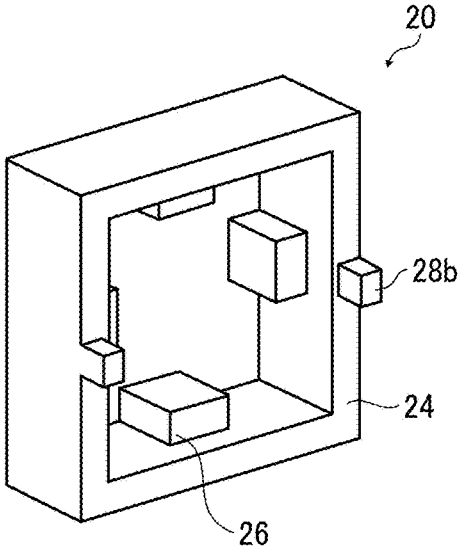

FIG. 14A, FIG. 14B, and FIG. 14C are three-view images of the shock absorber frame 20 and illustrate a pair of rectangular protrusions 28*b* formed on the first base structure 24, according to the second modification of the above embodiments of the present disclosure.

Figure 15A:
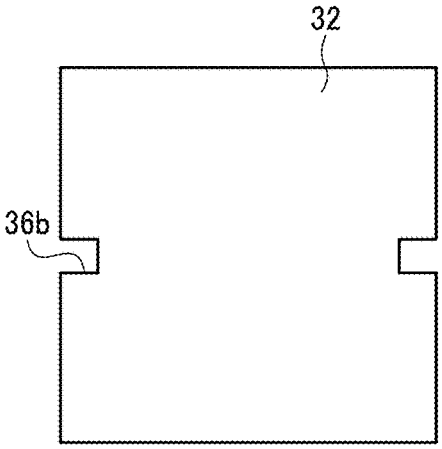
FIG. 15A, FIG. 15B, and FIG. 15C are three-view images of a shock absorber plate and illustrate a pair of concave portions formed on a second base structure, according to the second modification of the above embodiments of the present disclosure.
Figure 15B:
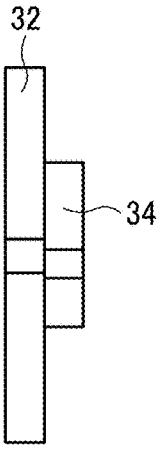
Figure 15C:
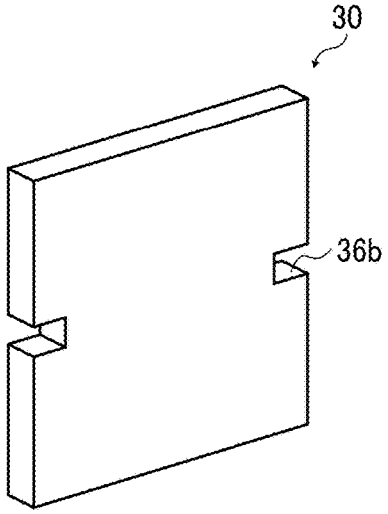

FIG. 15A, FIG. 15B, and FIG. 15C are three-view images of the shock absorber plate 30 and illustrate a pair of concave portions 36*a* formed on the second base structure 32, according to the second modification of the above embodiments of the present disclosure.

As illustrated in FIG. 14A, FIG. 14B, and FIG. 14C, a pair of rectangular protrusions 28*b* are formed on the first base structure 24 of the shock absorber frame 20.

As illustrated in FIG. 15A, FIG. 15B, and FIG. 15C, a pair of recessed portions 36*b* are formed on the second base structure 32 of the shock absorber plate 30. As the pair of rectangular protrusions 28*b* are lightly press-fitted into the pair of recessed portions 36*b*, the shock absorber frame 20 and the shock absorber plate 30 can be combined together. This configuration or structure also provide an easy and low-cost coupling or bonding method that does not require extra materials, and the shock absorber frame 20 and the shock absorber plate 30 can be prevented from being separated from each other.

Figure 16A:
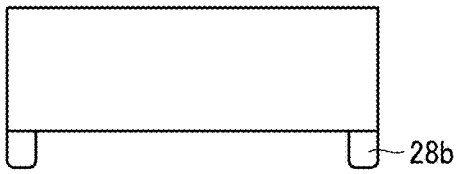
FIG. 16A, FIG. 16B, and FIG. 16C are three-view images of a shock absorber frame and illustrates a pair of rectangular chamfered protrusions, according to the second modification of the above embodiments of the present disclosure, where
Figure 16B:
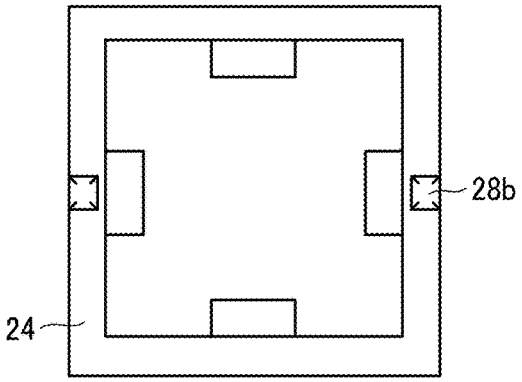
Figure 16C:
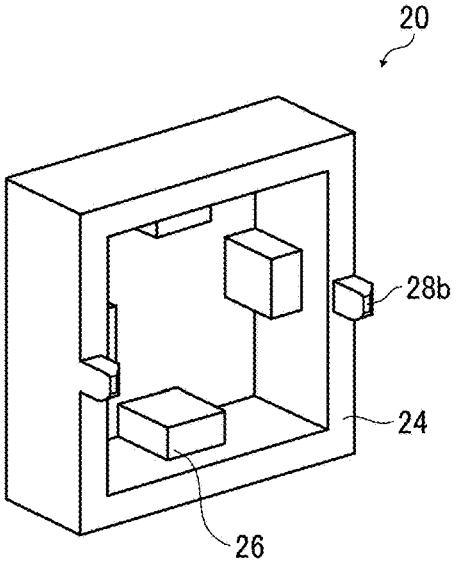

FIG. 16A, FIG. 16B, and FIG. 16C are three-view images of the shock absorber frame 20 and illustrates a pair of rectangular chamfered protrusions 28*bf*, according to the second modification of the above embodiments of the present disclosure.

As illustrated in FIG. 16A, FIG. 16B, FIG. 16C, each one of the pair of rectangular protrusions 28*b* may be chamfered to have a rounded face. When such protrusions are lightly press-fitted to concave or recessed portions, the rounded faces of the pair of protrusions 28*h* serve as guides, and smooth assembly is achieved. In particular, the pair of protrusions 28*b* can smoothly be press-fitted to the pair of recessed portions 36*b*. Each one of the pair of recessed portions 36*b* as illustrated in FIG. 15A, FIG. 15B, and FIG. 15C may be chamfered to have a rounded face. Alternatively, both the pair of protrusions 28*b* and the pair of recessed portions 36*b* may be chamfered to have rounded faces.

Third Modification

Figure 17A:
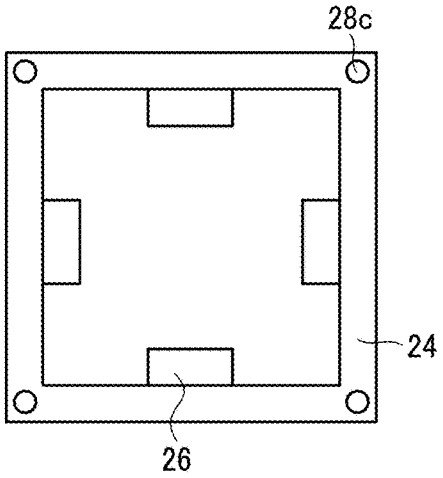
FIG. 17A, FIG. 17B, and FIG. 17C are three-view images of a shock absorber frame and illustrate a plurality of bosses formed on a first base structure, according to the third modification of the above embodiments of the present disclosure, where
Figure 17B:
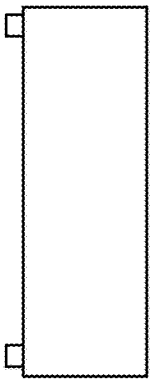
Figure 17C:
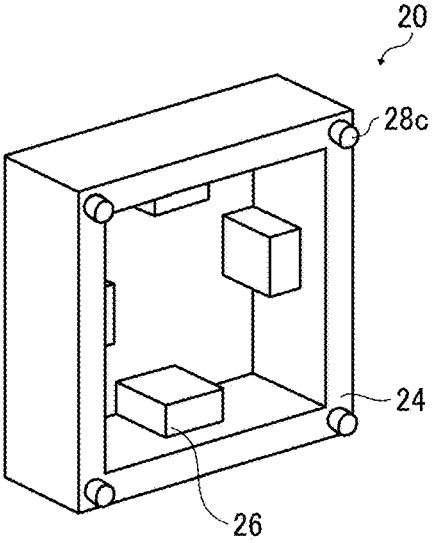

FIG. 17A, FIG. 17B, and FIG. 17C are three-view images of the shock absorber frame 20 and illustrate a plurality of bosses 28*c* formed on the first base structure 24, according to the present embodiment.

Figure 18A:
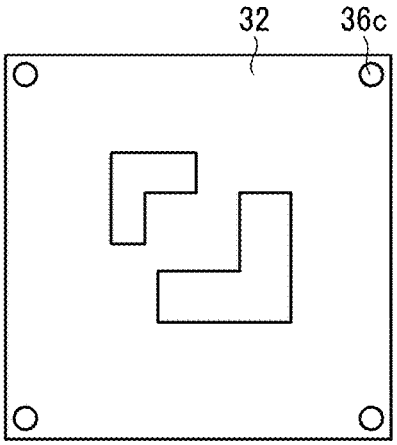
FIG. 18A, FIG. 18B, and FIG. 18C are three-view images of a shock absorber plate and illustrate a plurality of holes formed on a second base structure, according to the third modification of the above embodiments of the present disclosure, where
Figure 18B:
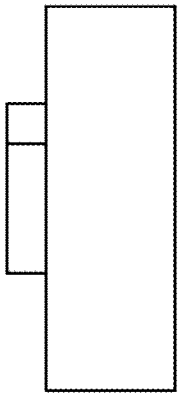
Figure 18C:
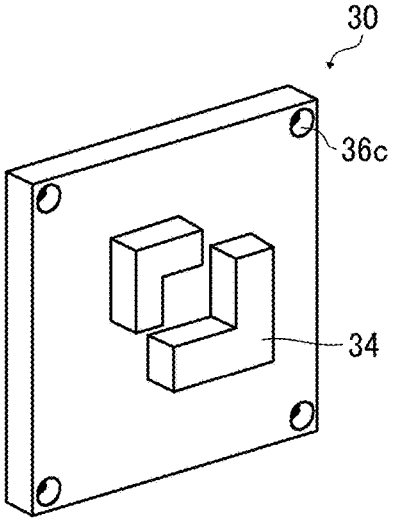

FIG. 18A, FIG. 18B, and FIG. 18C are three-view images of the shock absorber plate 30 and illustrate a plurality of holes 36*c* formed on the second base structure 32, according to the third modification of the above embodiments of the present disclosure.

Figure 19A:
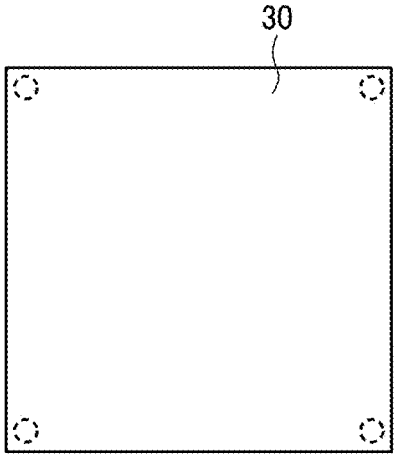
FIG. 19A, FIG. 19B, and FIG. 19C are three-view images of a shock absorber frame and a shock absorber plate and illustrates how the shock absorber frame and the shock absorber plate are combined together, according to the third modification of the above embodiments of the present disclosure, where
Figure 19B:
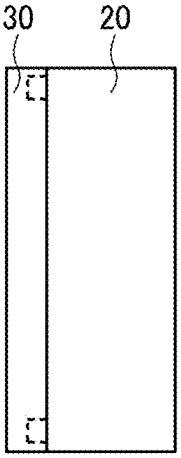
Figure 19C:
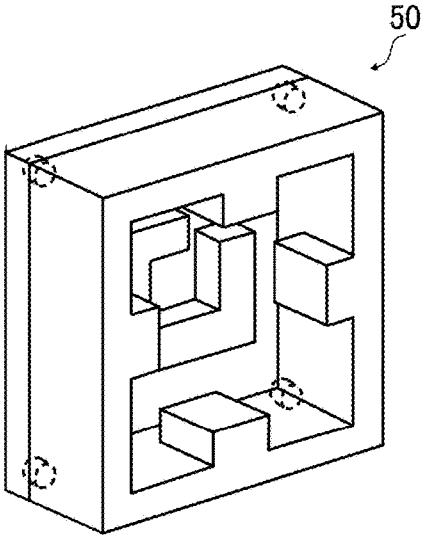

FIG. 19A, FIG. 19B, and FIG. 19C are three-view images of the shock absorber frame 20 and the shock absorber plate 30 and illustrates how the shock absorber frame 20 and the shock absorber plate 30 are combined together, according to the third modification of the above embodiments of the present disclosure.

As illustrated in FIG. 17A, FIG. 17B, and FIG. 17C, a plurality of bosses 28*c* are formed on the first base structure 24 of the shock absorber frame 20. As illustrated in FIG. 18A, FIG. 18B, and FIG. 18C, a plurality of holes 36*c* are formed on the second base structure 32 of the shock absorber plate 30. As the multiple bosses 28*c* are lightly press-fitted into the multiple holes 36*c*, the shock absorber frame 20 and the shock absorber plate 30 can be combined together (see, for example, FIG. 19A, FIG. 19B, and FIG. 19C).

At least one of the multiple bosses 28*c* or multiple holes 36*c* may be chamfered to have a round shape.

This configuration or structure also provide an easy and low-cost coupling or bonding method that does not require extra materials, and the shock absorber frame 20 and the shock absorber plate 30 can be prevented from being separated from each other.

In the above three coupling or combining methods, a plurality of claw-shaped protrusions 28*a*, a plurality of rectangular protrusions 28*b*, or a plurality of bosses 28*c* may be formed on the first base structure 24 of the shock absorber frame 20, and a plurality of concave portions 36*a*, a plurality of recessed portions 36*b*, and a plurality of holes 36*c* may be formed on the second base structure 32 of the shock absorber plate 30.

The shock absorber 50 according to the above embodiments and their modifications of the present disclosure is used for a packaging system upon being attached to an image forming apparatus such as a copier and a printer that serves as the to-be-packaged object 14 or an apparatus such as a personal computer (PC) and a household electrical appliance that has a plane and upon being packed into an outer packaging box such as a cardboard box. A packaged baggage that is prepared using such a packaging system is delivered and handled as a cargo.

In the packaging system according to the present embodiment, a pair of shock absorbers 50 according to the above embodiments of the present disclosure may be used for each object to be packaged. Such a packaging system may be referred to as a two-pad packaging system. In response to the shock in six directions caused by, for example, drop of a packaged baggage, desired shock-absorbing effects can be achieved with a few number of components or elements.

Alternatively, in the packaging system according to the present embodiment, four shock absorber 50 according to the above embodiments of the present disclosure may be used for each object to be packaged. Such a packaging system may be referred to as a four-pad packaging system in the following description. In response to the shock in six directions caused by, for example, drop of a packaged baggage, further shock-absorbing effects can be achieved. Regarding the two shock absorbers among the four shock absorbers, the object to be packaged and the shock absorber can separately be stored in an outer packaging box. In view of the above circumstances, the four-pad packaging system is suitable for processability of packaging and automation of packaging processes.

Note that numerous additional modifications and variations are possible in light of the above teachings. It is therefore to be understood that within the scope of the appended claims, the embodiments of the present disclosure may be practiced otherwise than as specifically described herein. For example, elements and/or features of different illustrative embodiments may be combined with each other and/or substituted for each other within the scope of this disclosure and appended claims.

Any one of the above-described operations may be performed in various other ways, for example, in an order different from the one described above. Each of the functions of the described embodiments may be implemented by one or more processing circuits or circuitry. Processing circuitry includes a programmed processor, as a processor includes circuitry. A processing circuit also includes devices such as an application-specific integrated circuit (ASIC), digital signal processor (DSP), field-programmable gate array (FPGA), and conventional circuit components arranged to perform the recited functions.

Aspects of the present disclosure are given below

First Aspect

A shock absorber to be attached to an object to be packaged, the shock absorber comprising:

- a first shock absorber including a first base structure having a frame shape and at least one first shock-absorbing rib disposed inside the first base structure; and
- a second shock absorber having a second base structure in a shape of a plate and at least one second shock-absorbing rib disposed on a plane of the second base structure, the first shock absorber and the second shock absorber coupled to each other.

Second Aspect

In the shock absorber according to the first aspect, the first shock-absorbing rib of the first shock absorber is separate from the second base structure of the second shock absorber.

Third Aspect

In the shock absorber according to the first aspect or the second aspect, the first shock absorber and the second shock absorber are coupled to each other as a claw-shaped protrusion formed on the first base structure of the first shock absorber is snap-fitted into a concave portion formed on the second base structure of the second shock absorber.

Fourth Aspect

The shock absorber according to the third aspect, further comprising:

- a plurality of claw-shaped protrusions including the claw-shaped protrusion; and
- a plurality of concave portions including the concave portion, wherein the plurality of claw-shaped protrusions are formed on the first base structure of the first shock absorber, and wherein the plurality of concave portions are formed on the second base structure of the second shock absorber.

Fifth Aspect

In the shock absorber according to the first aspect or the second aspect, the first shock absorber and the second shock absorber are coupled to each other as a rectangular protrusion formed on the first base structure of the first shock absorber is lightly press-fitted into a recessed portion formed on the second base structure of the second shock absorber.

Sixth Aspect

In the shock absorber according to the fifth aspect, the rectangular protrusion or the recessed portion is chamfered to have a rounded face.

Seventh Aspect

The shock absorber according to the fifth aspect or the sixth aspect, further comprising:

a plurality of rectangular protrusions including the rectangular protrusion; and a plurality of recessed portions including the recessed portion, wherein the plurality of rectangular protrusions are formed on the first base structure of the first shock absorber, and wherein the plurality of recessed portions are formed on the second base structure of the second shock absorber.

Eighth Aspect

In the shock absorber according to the first aspect or the second aspect, the first shock absorber and the second shock absorber are coupled to each other as a boss formed on the first base structure of the first shock absorber is lightly press-fitted into a hole formed on the second base structure of the second shock absorber.

Ninth Aspect

The shock absorber according to the eighth aspect, further comprising:

a plurality of bosses including the boss; and a plurality of holes including the hole, wherein the plurality of bosses are formed on the first base structure of the first shock absorber, and wherein the plurality of holes are formed on the second base structure of the second shock absorber.

Tenth Aspect

The shock absorber according to any one of the first to ninth aspects, further comprising a plurality of first shock-absorbing ribs including the first shock-absorbing rib, wherein the plurality of first shock-absorbing ribs are disposed inside the first base structure, Eleventh Aspect The shock absorber according to any one of the first to tenth aspects, further comprising a plurality of first shock-absorbing ribs including the first shock-absorbing rib, wherein the first base structure has a plurality of inner walls, and wherein the plurality of shock-absorbing ribs are disposed on each one of the plurality of inner walls, Twelfth Aspect The shock absorber according to any one of the first to eleventh aspects, further comprising a plurality of second shock-absorbing ribs including the second shock-absorbing rib, wherein the plurality of second shock-absorbing ribs are disposed on a plane of the second base structure.

Thirteenth Aspect

In the shock absorber according to any one of the first to twelfth aspects, the first shock absorber and the second shock absorber are formed using a packaging material made of form resin.

Fourteenth Aspect

In the shock absorber according to any one of the first to twelfth aspects, the first shock absorber and the second shock absorber are formed using a packaging material made of pulp molding.

Fifteenth Aspect

In the shock absorber according to any one of the first to ninth aspects, the first shock absorber and the second shock absorber are formed using a vacuum-formed packaging material made of plastic sheet.

Sixteenth Aspect

A packaging system comprising a plurality of shock absorbers including the shock absorber according to any one of the first to fifteenth aspects, two of the plurality of shock absorbers used for each object to be packaged.

Seventeenth Aspect

A packaging system comprising a plurality of shock absorbers including the shock absorber according to any one of the first to fifteenth aspects, four of the plurality of shock absorbers used for each object to be packaged.

What is claimed is:

1. A shock absorber to be attached to an object to be packaged, the shock absorber comprising:

a first shock absorber including a first base structure having an annular frame shape that is open at two ends and at least one first shock-absorbing rib disposed inside the first base structure such that the at least one first shock-absorbing rib extends inwardly from the annular frame-shaped first base structure in a first direction; and a second shock absorber having a second base structure in a shape of a plate and at least one second shock-absorbing rib disposed on a plane of the second base structure such that the at least one second shock-absorbing rib extends inwardly from the plate-shaped second base structure in a second direction that is orthogonal to the first direction, the first shock absorber and the second shock absorber being coupled to each other at one of the two open ends of the first shock absorber, wherein the at least one first shock-absorbing rib of the first shock absorber is separate from the second base structure of the second shock absorber with a gap between the second base structure of the second shock absorber and a surface of the at least one first shock-absorbing rib of the first shock absorber which faces the second base structure of the second shock absorber, under conditions where:

the first shock absorber and the second shock absorber are coupled to each other and an inner surface of the at least one first shock-absorbing rib that faces in the first direction is configured to contact the object to be packaged, and an inner surface of the at least one second shock-absorbing rib that faces in the second direction is configured to contact the object to be packaged and the inner surface of the at least one first shock-absorbing rib and the inner surface of the at least one second shock-absorbing rib are configured to support the object to be packaged above the gap.

2. The shock absorber according to claim 1, wherein the first shock absorber and the second shock absorber are coupled to each other as a claw-shaped protrusion formed on the first base structure of the first shock absorber is snap-fitted into a concave portion formed on the second base structure of the second shock absorber.

3. The shock absorber according to claim 2, further comprising:

a plurality of claw-shaped protrusions including the claw-shaped protrusion; and a plurality of concave portions including the concave portion, wherein the plurality of claw-shaped protrusions are formed on the first base structure of the first shock absorber, and wherein the plurality of concave portions are formed on the second base structure of the second shock absorber.

4. The shock absorber according to claim 1, wherein the first shock absorber and the second shock absorber are coupled to each other as a rectangular protrusion formed on the first base structure of the first shock absorber is press-fitted into a recessed portion formed on the second base structure of the second shock absorber.

5. The shock absorber according to claim 2, wherein the rectangular protrusion or the recessed portion is chamfered to have a rounded face.

6. The shock absorber according to claim 4, further comprising:

a plurality of rectangular protrusions including the rectangular protrusion; and a plurality of recessed portions including the recessed portion, wherein the plurality of rectangular protrusions are formed on the first base structure of the first shock absorber, and wherein the plurality of recessed portions are formed on the second base structure of the second shock absorber.

7. The shock absorber according to claim 1, wherein the first shock absorber and the second shock absorber are coupled to each other as a boss formed on the first base structure of the first shock absorber is press-fitted into a hole formed on the second base structure of the second shock absorber.

8. The shock absorber according to claim 7, further comprising:

a plurality of bosses including the boss; and a plurality of holes including the hole, wherein the plurality of bosses are formed on the first base structure of the first shock absorber, and wherein the plurality of holes are formed on the second base structure of the second shock absorber.

9. The shock absorber according to claim 1, wherein the at least one first shock-absorbing rib includes a plurality of first shock-absorbing ribs, and wherein the plurality of first shock-absorbing ribs are disposed inside the first base structure.

10. The shock absorber according to claim 1, wherein the at least one first shock-absorbing rib includes a plurality of first shock-absorbing ribs, wherein the first base structure has a plurality of inner walls, and wherein the plurality of first shock-absorbing ribs are disposed on each one of the plurality of inner walls.

11. The shock absorber according to claim 1, wherein the at least one second shock-absorbing rib includes a plurality of second shock-absorbing ribs, and wherein the plurality of second shock-absorbing ribs are disposed on the plane of the second base structure.

12. The shock absorber according to claim 1, wherein the first shock absorber and the second shock absorber are formed using a packaging material made of foamed resin.

13. The shock absorber according to claim 1, wherein the first shock absorber and the second shock absorber are formed using a packaging material made of pulp molding.

14. The shock absorber according to claim 1, wherein the first shock absorber and the second shock absorber are formed using a vacuum-formed packaging material made of plastic sheet.

15. The shock absorber according to claim 1, wherein the at least one first shock-absorbing rib of the first shock absorber is spaced apart from the second base structure of the second shock absorber.

16. The shock absorber according to claim 1, wherein, in the first shock absorber and the second shock absorber that are coupled to each other, the annular-shaped first base structure contacts the plate-shaped second base structure.

17. A packaging system comprising:

a plurality of shock absorbers to be attached to an object to be packaged, the plurality of shock absorbers each including:

a first shock absorber including a first base structure having an annular frame shape that is open at two ends and at least one first shock-absorbing rib disposed inside the first base structure such that the at least one first shock-absorbing rib extends inwardly from the annular frame-shaped first base structure in a first direction; and a second shock absorber having a second base structure in a shape of a plate and at least one second shock-absorbing rib disposed on a plane of the second base structure such that the at least one second shock-absorbing rib extends inwardly from the plate-shaped second base structure in a second direction that is orthogonal to the first direction, wherein the first shock absorber and the second shock absorber are coupled to each other at one of the two open ends of the first shock absorber, wherein two of the plurality of shock absorbers are used for each object to be packaged, and wherein the at least one first shock-absorbing rib of the first shock absorber is separate from the second base structure of the second shock absorber with a gap between the second base structure of the second shock absorber and a surface of the at least one first shock-absorbing rib of the first shock absorber which faces the second base structure of the second shock absorber, under conditions where:

the first shock absorber and the second shock absorber are coupled to each other and an inner surface of the at least one first shock-absorbing rib that faces in the first direction is configured to contact the object to be packaged, and an inner surface of the at least one second shock-absorbing rib that faces in the second direction is configured to contact the object to be packaged and the inner surface of the at least one first shock-absorbing rib and the inner surface of the at least one second shock-absorbing rib are configured to support the object to be packaged above the gap.

18. The packaging system according to claim 17, wherein the at least one first shock-absorbing rib of the first shock absorber is spaced apart from the second base structure of the second shock absorber.

* * * * *